US009444200B2

(12) United States Patent
Yen et al.

(10) Patent No.: US 9,444,200 B2
(45) Date of Patent: Sep. 13, 2016

(54) ELECTRICAL CONNECTOR AND MANUFACTURING METHOD THEREOF

(71) Applicant: Chant Sincere Co., Ltd., New Taipei (TW)

(72) Inventors: Ming Hui Yen, New Taipei (TW); Chun-Hsiang Hsu, New Taipei (TW)

(73) Assignee: CHANT SINCERE CO., LTD. (TW)

( * ) Notice: Subject to any disclaimer, the term of this patent is extended or adjusted under 35 U.S.C. 154(b) by 0 days.

(21) Appl. No.: 14/794,878

(22) Filed: Jul. 9, 2015

(65) Prior Publication Data

US 2016/0036175 A1 Feb. 4, 2016

(30) Foreign Application Priority Data

Jul. 31, 2014 (TW) ..... 103126184 A

(51) Int. Cl.

| | |
|---|---|
| ***H01R 24/00*** | (2011.01) |
| ***H01R 24/60*** | (2011.01) |
| *H01R 43/20* | (2006.01) |
| *H01R 107/00* | (2006.01) |
| *H01R 12/72* | (2011.01) |
| *H01R 13/405* | (2006.01) |

(52) U.S. Cl.

CPC ..... *H01R 24/60* (2013.01); *H01R 12/724* (2013.01); *H01R 13/405* (2013.01); *H01R 43/205* (2013.01); *H01R 2107/00* (2013.01)

(58) Field of Classification Search

CPC ..... H01R 23/7073; H01R 23/7005

USPC ..... 439/660, 626, 374, 377, 79, 733

See application file for complete search history.

(56) References Cited

U.S. PATENT DOCUMENTS

| | | | | | |
|---|---|---|---|---|---|
| 5,766,025 | A * | 6/1998 | Davis | H01R 13/26 | 439/660 |
| 5,836,792 | A * | 11/1998 | Thumma | H01R 12/585 | 439/736 |
| 2010/0112862 | A1* | 5/2010 | Chiu | H01R 13/65802 | 439/607.23 |
| 2010/0255710 | A1* | 10/2010 | Lin | H01R 23/6873 | 439/374 |
| 2012/0021651 | A1* | 1/2012 | Ho | H01R 13/506 | 439/626 |
| 2015/0340821 | A1* | 11/2015 | Yen | H01R 24/62 | 439/607.01 |
| 2016/0036175 | A1* | 2/2016 | Yen | H01R 24/60 | 439/676 |

* cited by examiner

*Primary Examiner* — Phuongchi T Nguyen
(74) *Attorney, Agent, or Firm* — Bacon & Thomas, PLLC

(57) ABSTRACT

An electrical connector comprises a casing, an insulative base and at least one first terminal. The casing has an inner space and an opening communicated with the inner space. The insulative base is disposed in the inner space. The first terminal is disposed within the insulative base and includes a terminal body and an actuator. The terminal body includes a first contact portion and a first center portion. The actuator is protruded from the first center portion along a normal line of a contact area of the first contact portion and has stopped up before the insulative base; and the method of manufacturing method of the same.

8 Claims, 15 Drawing Sheets

ELECTRICAL CONNECTOR AND MANUFACTURING METHOD THEREOF

CROSS-REFERENCE TO RELATED APPLICATIONS

This application claims the benefit of the filing date under 35 U.S.C. §119(a)-(d) of Taiwan Patent Application No. 103126184, filed Jul. 31, 2014.

BACKGROUND OF THE INVENTION

1. Field of the Invention

The present invention relates to a terminal, an electrical connector and a manufacturing method thereof, and more particularly, to an electrical connector and a manufacturing method thereof which have a high assembly yield rate.

2. Description of the Related Art

Currently, an USB 2.0 electrical connector, which is a common product in the market, has four terminals arranged in a row. Since a width of the USB 2.0 electrical connector is approximately close to the width of a finger, and each of the terminal has a specific width and a specific structural strength, the terminal, when is installed into the insulative base, may be easily pushed into the insulative base by an operator to complete the installation, and thereafter the operator can determine whether the terminal has been properly installing on the insulative base only by visual determination.

With the advance of technology, the size of an electrical connector becomes smaller, and the number of the terminals increases as the transmission standard is improved. Taking an USB C-type electrical connector as an example of a new electrical connector standard, we can find that its entire size is smaller than that of an USB 2.0 connector, and each USB C-type electrical connector has two rows of terminals in which each row has 12 terminals. In other words, this kind of connector is with a smaller space of the insulative base but it requires installing a larger number of terminals within the space. Furthermore, since the insulative base of the electrical connector has holes corresponding to the terminals, the increase of the number of the terminals, the decrease the structural strength of the insulative base becomes. Moreover, since the width of the USB 2.0 electrical connectors becomes narrower, the structural strength of the insulative base becomes weaker. For such electrical connectors, the terminal may skewed when being installed into the insulative base while various pushing forces is applied by different operators to thus cause the terminals not being able to be correctly installed into the insulative base. Moreover, because the width of the terminal is too small and the number of the terminal is quite large, it is difficult for the operator to visually determine whether the terminals are correctly installed into the insulative base. Therefore, the installation for such connectors usually has a higher defective rate.

SUMMARY OF THE INVENTION

The present invention provides an electrical connector having the above terminals.

The present invention provides a manufacturing method of the electrical connector, by which the terminal is not easily to become skewed when being installed into the insulative base.

In the present invention, the electrical connector comprises a casing, an insulative base and at least one first terminal. The casing has an inner space and an opening communicated with the inner space. The insulative base is disposed in the inner space. The first terminal is disposed within the insulative base and includes a terminal body and an actuator. The terminal body includes a first contact portion, a first center portion and a first connecting portion which are sequentially connected. The first contact portion is adjacent to the opening for contacting a docking terminal, and the first connecting portion is used for connecting a printed circuit board. The actuator is protruded from the first center portion along a normal line of a contact area of the first contact portion and contacts the insulative base.

In one embodiment of the present invention, the insulative base includes a principle base and a tongue which protrudes from the principle base and extending along a longitudinal direction. The position of the tongue is more adjacent to the opening as compared with that of the principle base. The principle base includes at least one first groove extending along the longitudinal direction. The tongue includes at least one top cavity extending along the longitudinal direction and communicating with the at least one first groove. The at least one top cavity is exposed on the top surface of the tongue. The first contact portion is located within the top cavity of the tongue. The first center portion penetrates through the first groove.

In one embodiment of the present invention, the electrical connector further includes a plurality of second terminals and a plurality of third terminals. The principle base further includes a plurality of second grooves extending along a longitudinal direction, and the tongue includes a plurality of bottom cavities extending along a longitudinal direction and communicating with these second grooves. These bottom cavities are exposed on the bottom surface of the tongue. The plurality of second terminals and the plurality of third terminals penetrate these second grooves and are located within these bottom cavities.

In one embodiment of the present invention, each of the second terminals includes a second connecting portion, and each of the third terminals includes a third connecting portion. These second connecting portions and these third connecting portions are located in different planes.

In one embodiment of the present invention, the actuator includes an actuator face adjacent to the first connecting portion and a ramped portion adjacent to the first contact portion. The actuator face is perpendicular to a perimeter of the first center portion in contact with the actuator. The angle between the ramped portion and the perimeter is not a right angle, and the ramped portion faces toward the first contact portion and contacts the principle base.

In one embodiment of the present invention, the first center portion is provided with a retainer which is located on a section between the actuator and the first contact portion and extends in a direction perpendicular to the normal line. The retainer is engaged with the principle base.

A manufacturing method of electrical connector in the present invention comprises steps of providing an insulative base, wherein the insulative base includes at least one first groove; providing at least one first terminals, each of which includes a terminal body and an actuator protruded the terminal body; penetrating in advance a part of the terminal body into the at least one first groove, wherein a gap is existed between the actuator and the insulative base; and pushing the actuator until it contacts the insulative base.

In one embodiment of the present invention, the insulative base includes a principle base and a tongue protruded from the principle base and extending along a longitudinal direction. The principle base includes at least one first groove extending along the longitudinal direction. The tongue includes at least one top cavity extending along the longitudinal direction and communicating with the at least one first groove. The at least one top cavity is exposed on the top surface of the tongue.

In one embodiment of the present invention, the terminal body includes a first contact portion, a first center portion and a first connecting portion which are sequentially connected. The actuator protrudes from the first center portion in a direction along a normal line of a contact area of the first contact portion. In the step of penetrating in advance the partial portion of the terminal body into the at least one first groove, the first contact portion is disposed in the first groove.

In one embodiment of the present invention, when the actuator is contacted with the insulative base, the first contact portion is inserted into the top cavity, the first center portion penetrates through the first groove, and the actuator contacts the principle base of the insulative base.

In one embodiment of the present invention, the actuator includes an actuator face adjacent to the first connecting portion and a ramped portion adjacent to the first contact portion. The actuator face is perpendicular to a perimeter of the first center portion in contact with the actuator. The angle between the ramped portion and the perimeter is not a right angle, and the ramped portion faces toward the first contact portion.

In one embodiment of the present invention, the first center portion is provided with a retainer which is located on a section between the actuator and the first contact portion and extends in a direction perpendicular to the normal line. The retainer is engaged with the principle base when the actuator is contacted with the insulative base.

Based on the above, because of the protruded actuator being provided on the first center portion in the present invention, when the terminal is installed into the insulative base, it only requires the first contact portion of the terminal to be disposed in the first groove in advance such that the actuator may be pushed by an operator by using jigs or by hand to push the first contact portion into the top cavity to complete the assembling thereof. While the actuator is pushed by using jigs, the pushing force is constant, so the terminal is not easily skewed when being installed into the insulative base. Even when the actuator is pushed by hand, the existing of the actuator increases the contacting area between the fingers of operator and the terminal, thereby, increasing the probability of correctly installing the terminal into the insulative base.

To clarify the above features and advantages of the present invention, the follows describes several embodiments accompanied with drawings in detail.

DETAILED DESCRIPTION OF THE EMBODIMENT(S)

Figure 1:
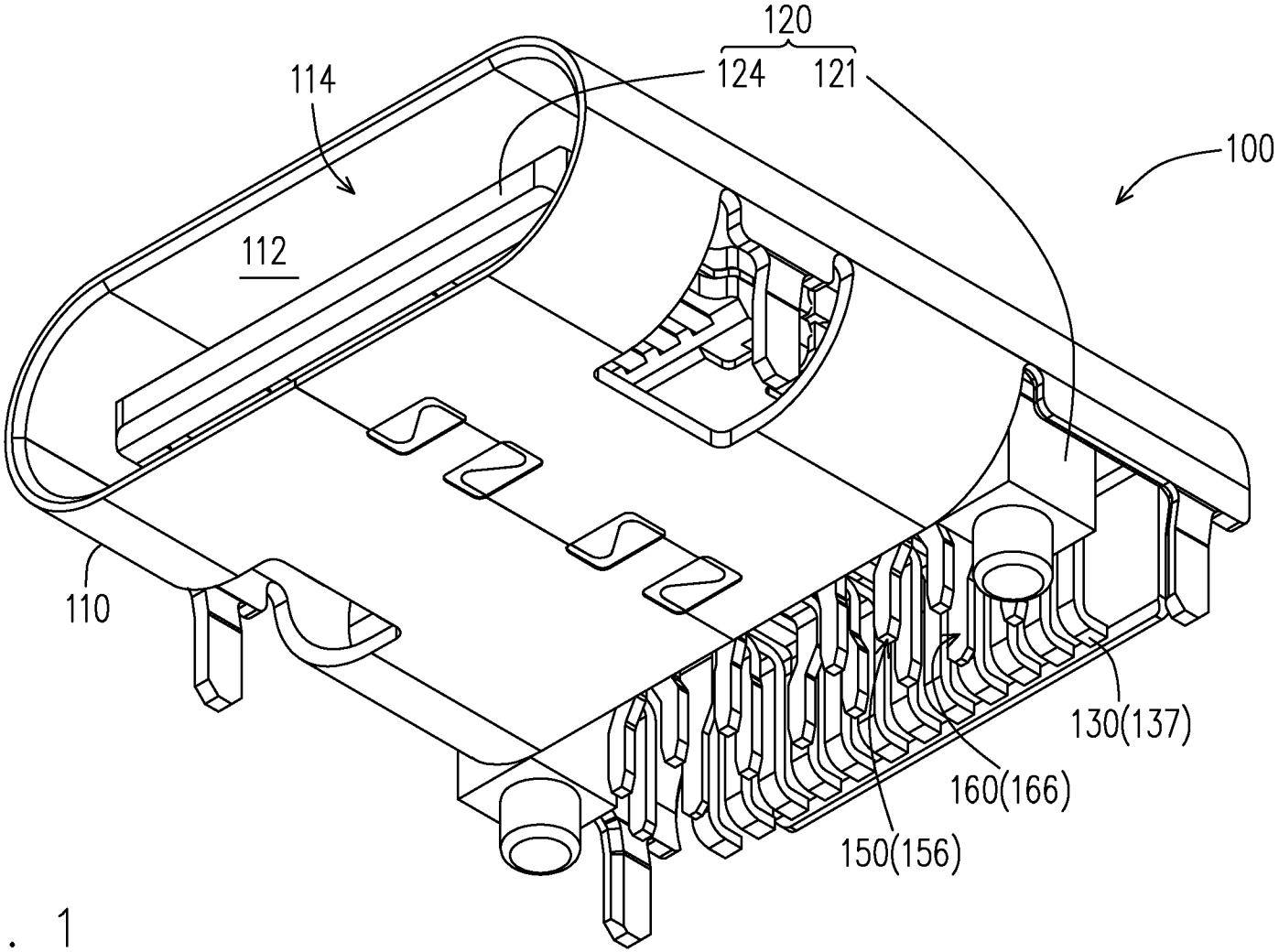
FIG. 1 is a stereogram illustrating an electrical connector according to an embodiment of the present invention.
Figure 2:
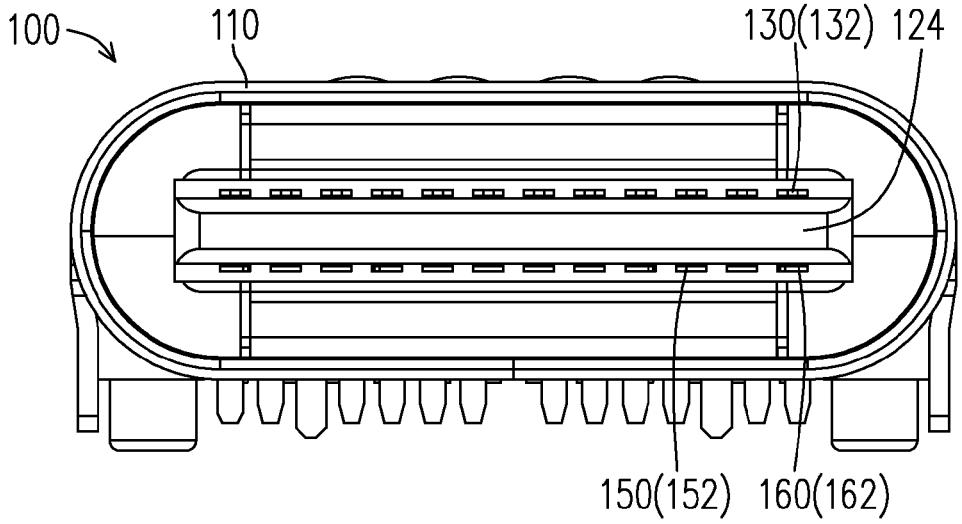
FIG. 2 and FIG. 3 are other perspective views of the electrical connector shown in FIG. 1.
Figure 3:
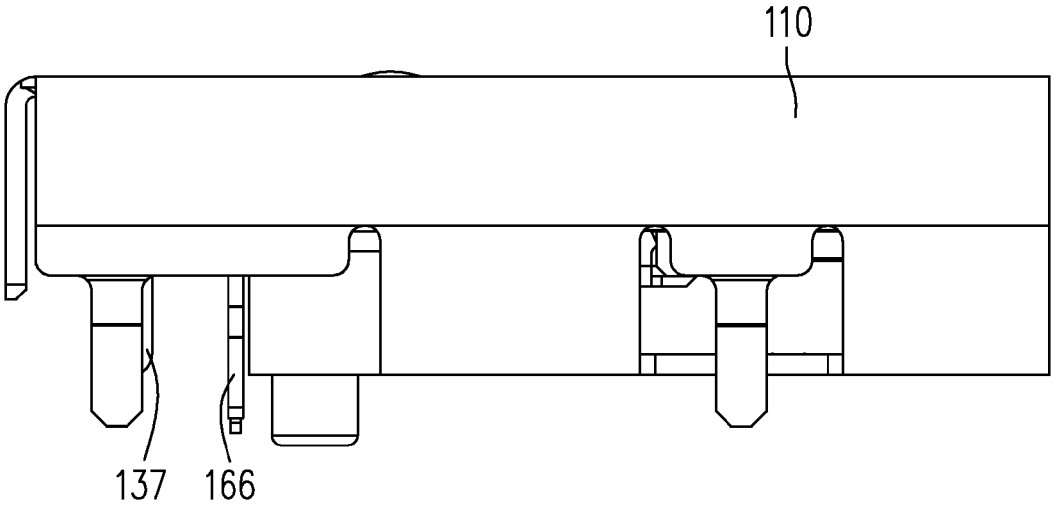

FIG. 1 is a stereogram illustrating an electrical connector according to an embodiment of the present invention. FIG. 2 and FIG. 3 are other perspective views of the electrical connector shown in FIG. 1. As shown in FIG. 1 to FIG. 3, in the embodiment, a USB C-type female electrical connector is taken as an example of an electrical connector 100. However, the electrical connector 100 is not limited to this. The electrical connector 100 of the embodiment includes a casing 110, an insulative base 120, a plurality of first terminals 130, a plurality of second terminals 150 and a plurality of third terminals 160.

The casing 110 has an inner space 112 and an opening 114 communicated with the inner space 112. The insulative base 120 is disposed in the inner space 112. In the embodiment, the insulative base 120, i.e. a plastic core, is made of insulating material, such as resins or polymer materials. However, the material of the insulative base 120 is not limited to this and may be any insulating materials.

As shown in FIG. 2, in the embodiment, the number of the first terminals 130 is 12, and the number of the second terminals 150 and the third terminals 160 in total is 12. Specifically, the number of the second terminals 150 is 5, and the number of the third terminals 160 is 7. At a position proximal to the opening of the casing 110, the first terminals 130 are located on the same plane, and the second terminals 150 and the third terminals 160 are arranged in a partially staggered manner and are located on another plane below the first terminals 130.

However, in other embodiments, the number of the first terminals 130, the second terminals 150 and the third terminals 160 is not limited to this, and the arrangement is not limited to get proximal to the opening of the casing 110. In an embodiment which is not shown, according to different types of the electrical connector 100, the electrical connector 100 may only have the first terminals 130. Alternatively, the electrical connector 100 may only have the first terminals 130 and the second terminals 150. At a position proximal to the opening of the casing 110, the first terminals 130 can be located on different plane. Alternatively, at a position proximal to the opening of the casing 110, the first terminals 130 and the second terminals 150 can be located on the same plane.

Figure 4:
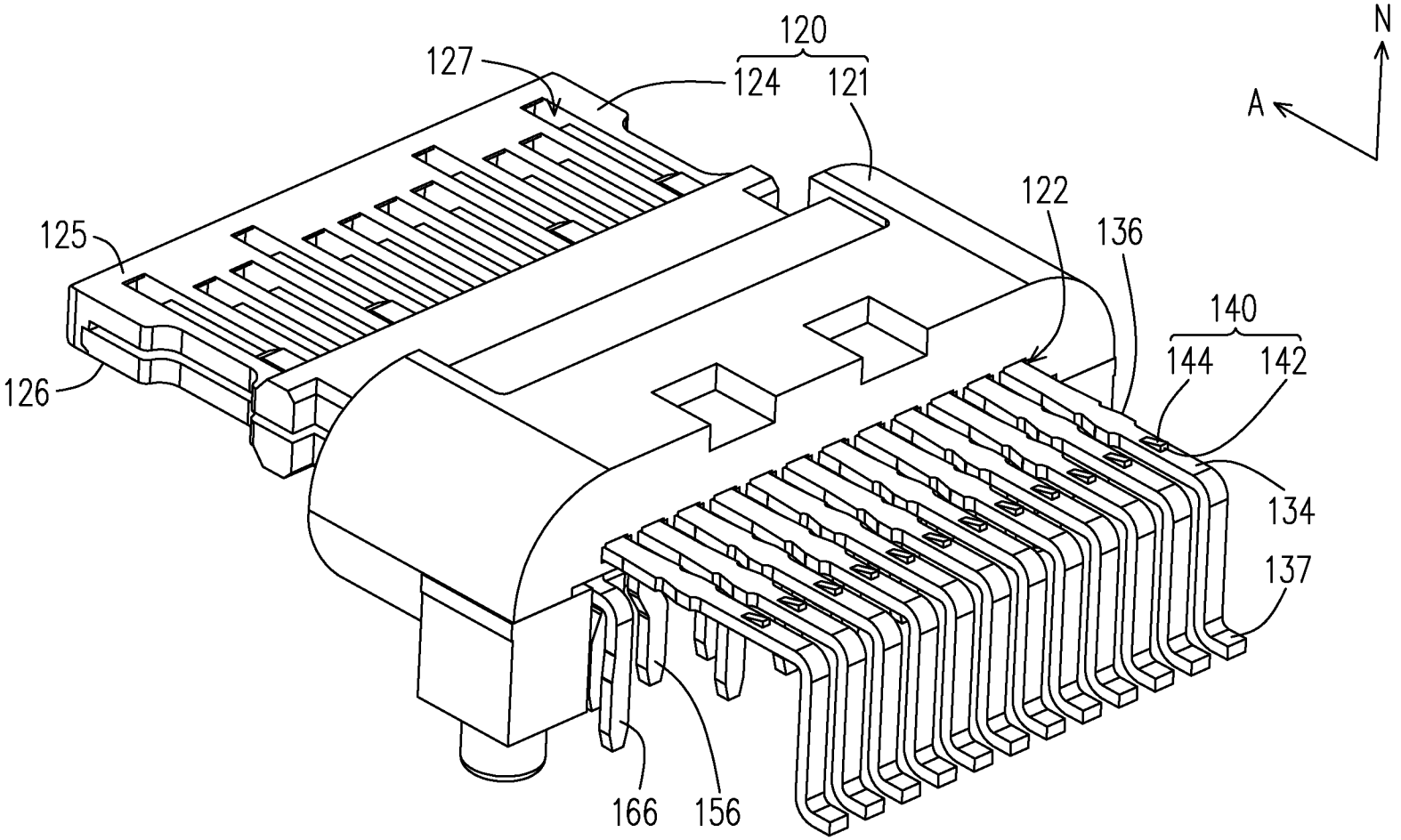
FIG. 4 is a schematic diagram illustrating the electrical connector shown in FIG. 1, in which the first terminal is penetrated in advance into the first groove.
Figure 5:
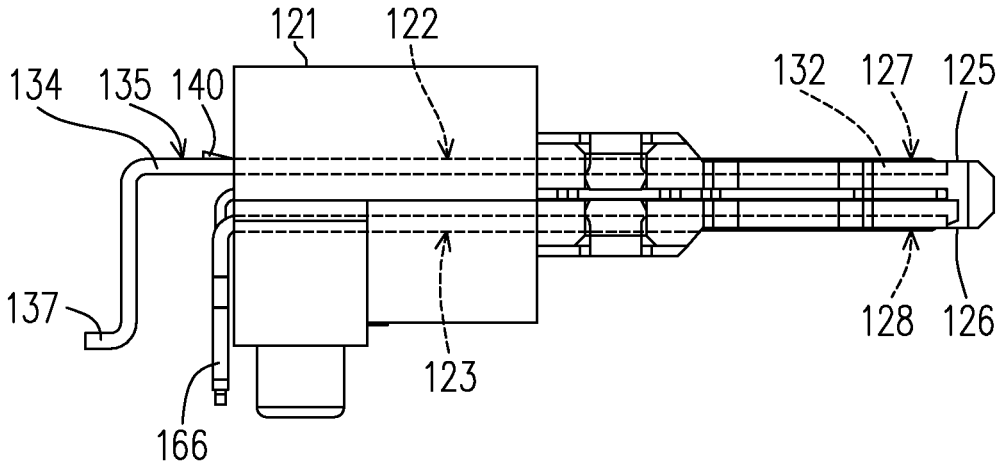
FIG. 5 is a schematic diagram illustrating the electrical connector shown in FIG. 1, in which the first terminal is installed into the first groove.
Figure 6:
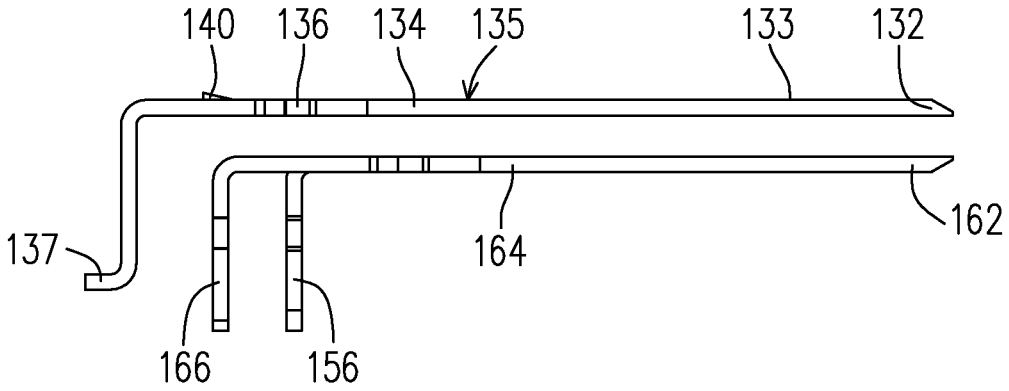
FIG. 6 is a side view illustrating a first terminal, a second terminal and a third terminal of the electrical connector shown in FIG. 1.

FIG. 4 is a schematic diagram illustrating the electrical connector shown in FIG. 1, in which the first terminal is penetrated in advance into the first groove. FIG. 5 is a schematic diagram illustrating the electrical connector shown in FIG. 1, in which the first terminal is installed into the first groove. FIG. 6 is a side view illustrating a first terminal, a second terminal and a third terminal of the electrical connector shown in FIG. 1. As shown in FIG. 4 to FIG. 6, the insulative base 120 includes a principle base 121 and a tongue 124 which protrudes from the principle base 121 and extending along a longitudinal direction A. The position of the tongue 124 is more adjacent to the opening 114 of the casing 110 shown in FIG. 1 as compared with that of the principle base 121. The principle base 121 includes a plurality of first grooves 122 extending along the longitudinal direction A and a plurality of second grooves 123, wherein these first grooves 122 are located on same plane, and these second grooves 123 are located on another plane. The tongue 124 includes: a plurality of top cavities 127 extending along the longitudinal direction A and communicating with these first grooves 122, and a plurality of bottom cavities 128 communicating with these second grooves 123. The plurality of top cavities 127 is exposed on the top surface 125 of the tongue 124, and the plurality of bottom cavities 128 is exposed on the bottom surface 126 of the tongue 124.

In the embodiment, a partial portion of the first terminals 130 is inserted into the first grooves 122 and the top cavities 127, and a partial portion of the second terminals 150 and a partial portion the third terminals 160 are respectively inserted into the second grooves 123 and the bottom cavities 128.

Specifically, FIG. 6, in which the casing 110 and the insulative base 120 is not shown, illustrates the right side position is a position proximal to the opening 114 of the casing 110, and the left side position is a position distant from the opening 114 of the casing 110. A first terminal 130 includes a first contact portion 132, a first center portion 134 and a first connecting portion 137 which are sequentially connected. A second terminal 150 includes: a second contact portion 152; a second center portion 154, which is hidden behind the third center portion 164 and is not shown in FIG. 6; and a second connecting portion 156, in which these portions are sequentially connected. A third electrical connector 160 includes a third contact portion 162, a third center portion 164 and a third connecting portion 166 which are sequentially connected.

The first contact portions 132 and the first center portions 134 of the first terminals 130 are located on same plane, and a bending section is provided between the first center portion 134 and the first connecting portion 137 of each first terminal 130. The second contact portions 152 and the second center portions 154 of the second terminals 150 and the third center portions 164 and the third connecting portions 166 of the third electrical connectors 160 are located on another plane. Two bending sections are respectively provided between the second center portion 154 and the second connecting portion 156 of each second terminals 150 and between the third center portion 164 and the third connecting portion 166 of each third terminals 160, by being located on different location, and thus the second connecting portions 156 and the third connecting portions 166 are located on different vertical plane.

As shown in FIGS. 4 and 5, the first contact portions 132 are located on the top cavities 127 of the tongue 124, the second contact portions 152 and the third contact portions 162 are respectively located on the bottom cavities 128 of the tongue 124, and the locations of the first contact portions 132, the second contact portions 152 and the third contact portions 162 are adjacent to the opening 114 of the casing 110 as shown in FIG. 2 for contacting a docking terminal (not shown). The first center portions 134 penetrate through the first grooves 122, and the second center portions 154. The third center portions 164 respectively penetrate through the second grooves 123. The first connecting portions 137, the second connecting portions 156 and the third connecting portions 166 are exposed on the principle base 121 of the insulative base 120 and are suitable to connect to a printed circuit board which will be explained below by referring to FIG. 8.

In the embodiment, as an example, the first terminals 130 are installed by inserting the first terminals 130 into the insulative base 120, and the second terminals 150 and the third terminals 160 are fixed on the insulative base 120 by injection molding. When manufacturing the electrical connector 100 by injection molding, the second terminals 150 and the third terminals 160 are disposed on a specific position of a mold (not shown), and then plastic material is injected into a mold, and thereafter the second terminals 150 and the third terminals 160 are fixed on the insulative base 120 after the plastic material is cured. Therefore, although the space distance between the second terminals 150 and the third terminals 160 is small, the electrical connector can be successfully manufactured by this process. However, regarding the installation of the electrical connector, since an operator requires to have the first terminals 130 inserted into the insulative base 120 along the first grooves 122 and the top cavities 127, it is an issue with regard to how the first terminals 130 can be successfully and correctly inserted into the insulative base 120 if the width and height of the first terminals 130 being small and the number of the first terminals 130 being large are considered.

The below provides a design of a first terminal 130 in the embodiment by which the first terminal 130 can be easily and correctly installed via the structure of this first terminal 130.

Figure 7:
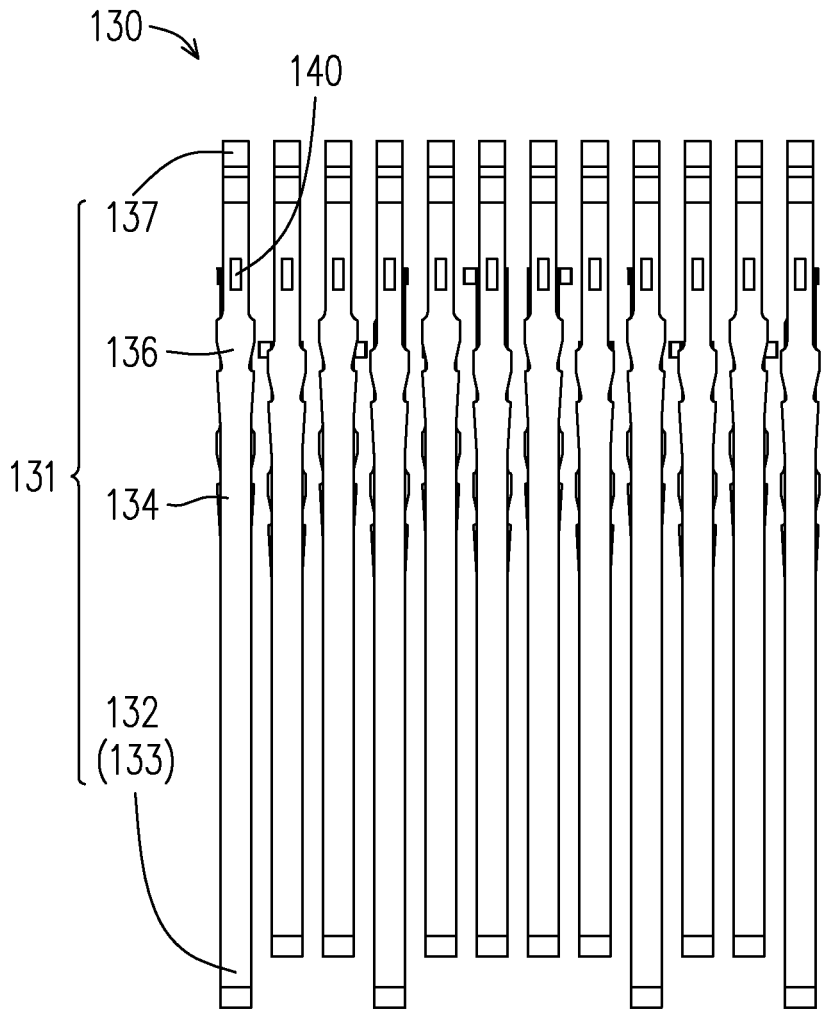
FIG. 7 is a top view illustrating the first terminal of the electrical connector shown in FIG. 1.

FIG. 7 is a top view illustrating the first terminal of the electrical connector shown in FIG. 1. As shown in FIGS. 4, 5 and 7 of the embodiment, a terminal body 131 of the first terminal 130 includes the first contact portion 132, the first center portion 134 and the first connecting portion 137 as mentioned previously. Moreover, the first terminal 130 further includes an actuator 140, and the actuator 140 is protruded from the first center portion 134 along a normal line N in a contact area 133 of the first contact portion 132, which is the thickness direction of the first center portion 134. In the embodiment, the actuator 140 includes: an actuator face 142 adjacent to the first connecting portion 137; and a ramped portion 144 adjacent to the first contact portion 132. The actuator face 142 is perpendicular to a perimeter 135 of the first center portion 134 in contact with the actuator 140. The angle between the ramped portion 144 and the perimeter 135 is not a right angle. However, the configuration of the actuator 140 is not limited to this.

In the embodiment, since the protruding actuator 140 is provided on the first center portion 134 of the first terminal, when the first terminal 130 is installed into the insulative base 120, it only requires the first contact portion 132 of the first terminal 130 to be disposed into the first grooves 122 in advance as shown in FIG. 4, during which, the actuator 140 located on the first center portion 134 is not contacted with the principle base 121 of the insulative base 120, and then the actuator face 142 of the actuator 140 can be pushed so as to push the first contact portion 132 into the top cavities 127. When the first contact portion 132 is pushed into the top cavities 127, the ramped portion 144 of the actuator 140 is contacted with the principle base 121 of the insulative base 120 as shown in FIG. 5, and the installation is completed.

While the actuators 140 of the first terminals 130 are pushed by using jigs, the pushing force is constant, so the first terminals 130 are not easily skewed when being installed into the insulative base 120. Even when the actuator 140 is installed into the insulative base 120 by hand, the existing of the actuator 140 increases the contacting area between the fingers of operator and the first terminals 130, thereby, increasing the probability of correctly installing the first terminals 130 into the insulative base 120.

It should be noted that, in the embodiment, all of the 12 first terminals are provided with the actuator 140. However, in other embodiments, it can optionally have only some ones of the first terminals 130 provided with the actuator 140 in consideration of the manufacturing process, by which this partial number of the first terminals 130 are installed into the insulative base 120 but the other first terminals 130 are manufactured by being injection molded on the insulative base 120. For example, when the first terminals 130 are installed into the insulative base 120, the first terminals 130 is not easily affected by dielectric constant of the insulative base 120 since the contacting area between the first terminals 130 and the insulative base 120 is small. Therefore, the terminals for transmitting high-frequency signal of the first terminals 130 may be installed into the insulative base 120, and the other first terminals 130 are manufactured by being injection molded on the insulative base 120.

Although the two different ways to dispose the first terminals 130 on the insulative base 120 are provided, the disposing manners are not limited to these. In addition, the types of terminal suitable for installing way of the first terminals 130 are not limited to the above. In addition, in other embodiments, the second terminals 150 and the third terminals 160 may be provided with the actuator 140, so as to be installed into the insulative base 120.

Figure 8:
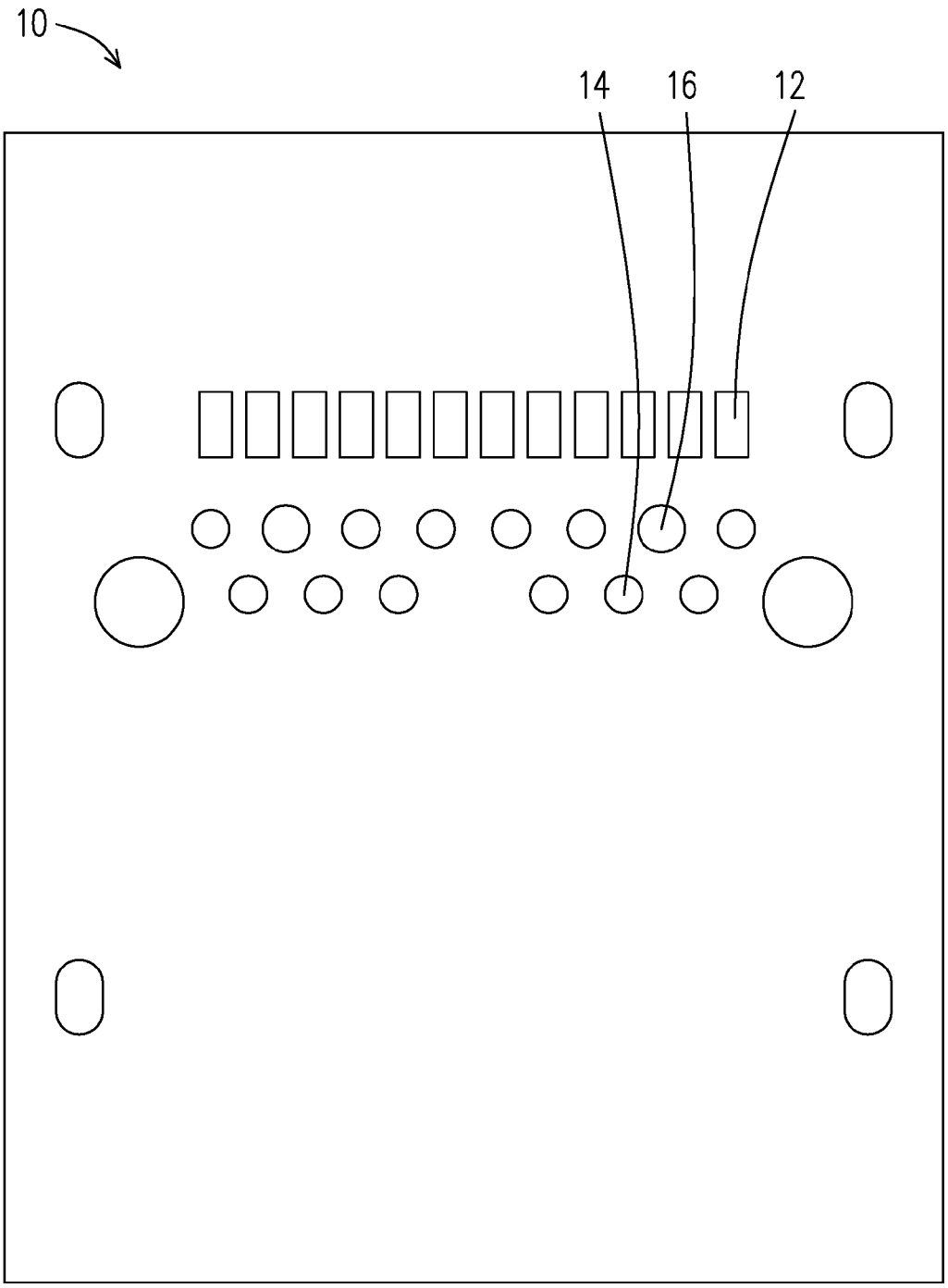
FIG. 8 is a schematic diagram illustrating a printed circuit board connected with the electrical connector shown in FIG. 1.

FIG. 8 is a schematic diagram illustrating a printed circuit board connected with the electrical connector shown in FIG. 1. As shown in FIG. 8, a printed circuit board 10 for connecting the electrical connector of FIG. 1 is illustrated in FIG. 8. In the embodiment, the printed circuit board 10 includes a plurality of first connecting areas 12 for connecting the first connecting portions 137, a plurality of second connecting areas 14 for connecting the second connecting portions 156, and a plurality of third connecting areas 16 for connecting the third connecting portions 166.

In this embodiment, as shown in FIG. 6, there are 12 first connecting portions 137 disposed in a row, there are 5 second connecting portions 156 disposed in another row, and there are 7 third connecting portions 166 disposed in a row between the first connecting portions 137 and the second connecting portions 156. Accordingly, as shown in FIG. 8, the arrangement positions of the first connecting areas 12, the second connecting areas 14 and the third connecting areas 16 of the printed circuit board 10 are disposed in 3 rows. In other words, the first connecting areas 12 are disposed in a row, the second connecting areas 14 are disposed in another row, and the third connecting areas 16 are disposed in a row between the first connecting areas 12 and the second connecting areas 14.

In addition, in the embodiment, the number of the first connecting areas 12 is set corresponding to the number of the first terminals 130, i.e. the number of the first connecting areas 12 is 12. The number of the second connecting areas 14 and the third connecting areas 16 are respectively larger than or equal to the number of the second terminals 150 and the third terminals 160. In the embodiment, the number of the second connecting areas 14 is 6, and the number of the third connecting areas 16 is 8. However, the total number of the second connecting areas 14 and the third connecting areas 16 are not limited to this.

Since the first connecting portions 137 of the first terminals 130 are connected with the printed circuit board 10 by being disposed in the same row to connect with the first connecting areas 12, the space distances between the first connecting areas shall be configured to be small for receiving the 12 first connecting areas 12 in the row. On the other hand, since the second connecting portions 156 of the second terminals 150 and the third connecting portions 166 of the third terminals 160 are disposed in different row and are respectively connected with the second connecting areas 14 and the third connecting areas 16 when the second connecting portions 156 and the third connecting portions 166 are connected with the printed circuit board 10, the space distances between the second connecting areas 14 and the space distances between the third connecting areas 16 are larger than the space distances between the first connecting areas 12. However, the numbers and the arrangement positions with respect to the first connecting areas 12, the second connecting areas 14 and the third connecting areas 16 may be changed according to the design of the electrical connector 100.

While in FIG. 8 the space distance between the neighboring first connecting areas 12 is equal, the space distance between the neighboring second connecting areas 14 is equal, the space distance between the neighboring third connecting areas 16 is equal, and the space distance between the neighboring second connecting areas 14 is equal to the space distance between the neighboring third connecting areas 16, It is noted that, in other embodiments, the space distances with regard to the neighboring second connecting areas 14 may be different, and the space distances with regard to the third connecting areas 16 may be different. In other words, the space distance between the two neighboring second connecting areas 14 or the two neighboring third connecting areas 16 may be configured as being different according to a requirement, so as to provide a high configurability for the second connecting areas 14 and the third connecting areas 16.

Please refer back to FIGS. 4 and 7. In order to securely fix the first terminals 130 on the insulative base 120, in the embodiment, the first center portion 134 is provided with a retainer 136 which is located on a section between the actuator 140 and the first contact portion 132 in a way of being extended in a direction N perpendicular to the normal line, i.e. in a direction toward a width of the first center portion 134. When the installation of the first terminals 130 and the insulative base 120 is completed by which the actuator 140 is pushed to the principle base 121, the retainer 136 is engaged with the principle base 121 to achieve a retaining function. Likewise, the second terminals 150 and the third terminals 160 may be configured by providing the retainer 136 in the same way.

Moreover, the type of the electrical connector 100 is not limited to above-described embodiments. An electrical connector 200 is described below.

Figure 9:
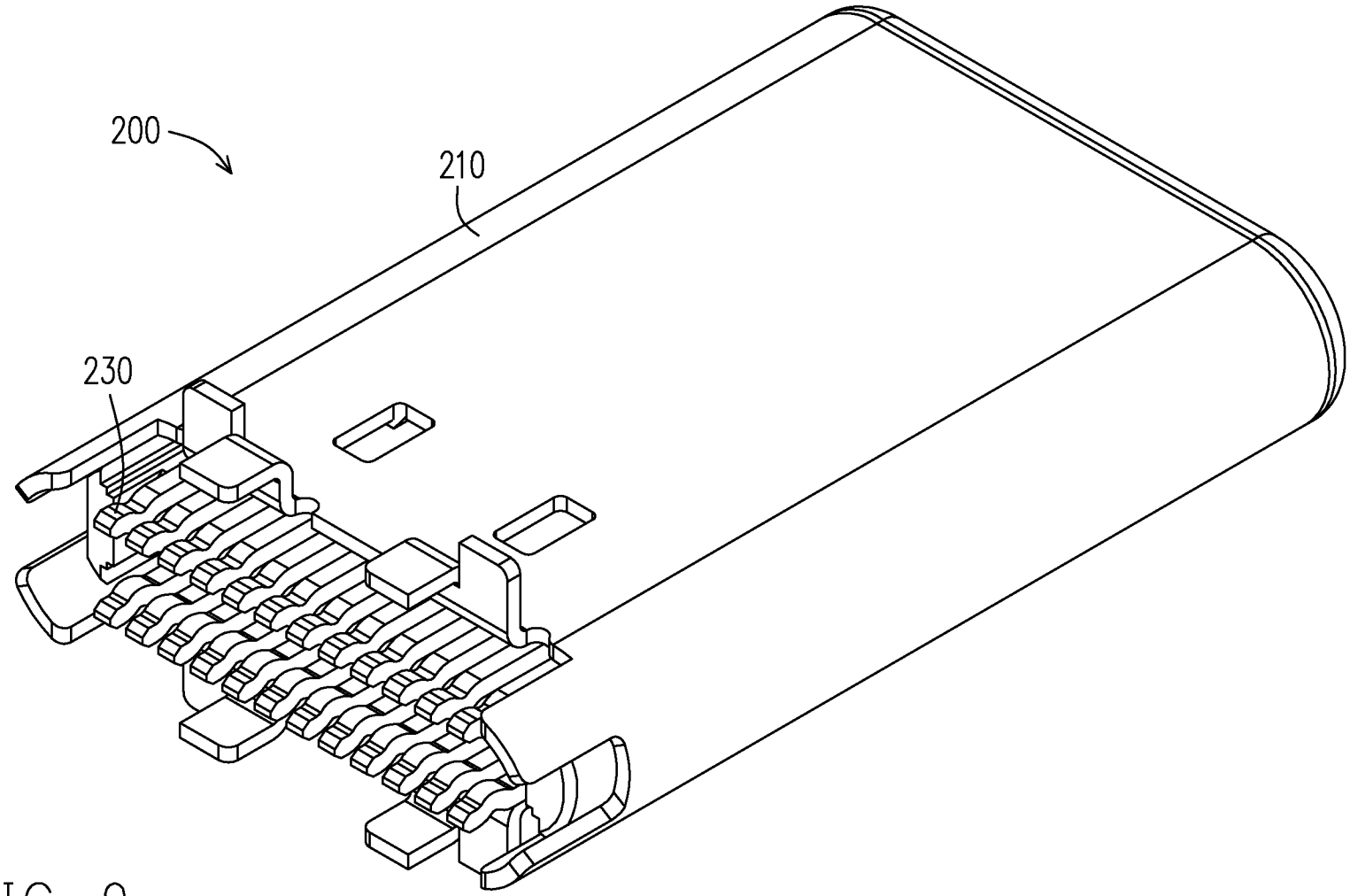
FIG. 9 is a schematic diagram illustrating an electrical connector according to another embodiment of the present invention.
Figure 10:
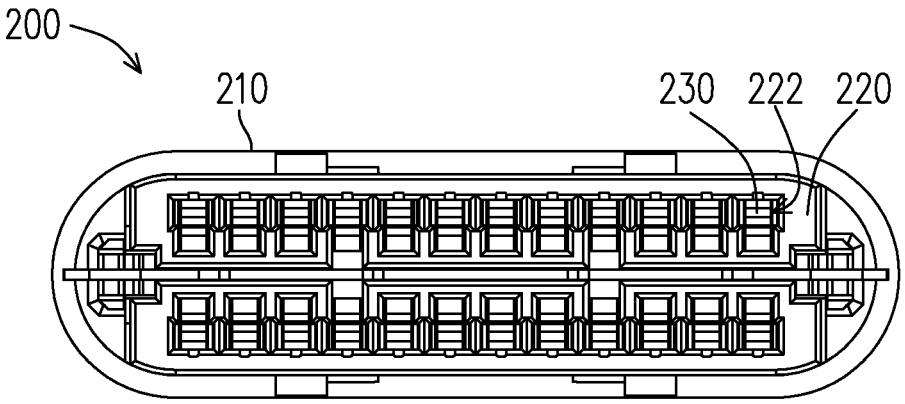
FIG. 10 is a front view illustrating the electrical connector shown in FIG. 9.

FIG. 9 is a schematic diagram illustrating an electrical connector according to another embodiment of the present invention. FIG. 10 is a front view illustrating the electrical connector shown in FIG. 9. Please refer to FIGS. 9 and 10, in which the type of the electrical connector 200 in the embodiment is chosen as a USB C type male connector. However, the type of the electrical connector 200 is not limited to this. In this embodiment, the electrical connector 200 includes a casing 210, an insulative base 220 and a plurality of terminals 230. The insulative base 220 is disposed in the casing 210. In the embodiment, the insulative base 220, i.e. a plastic core, is made of insulating material, such as resins or polymer materials. However, the material of the insulative base 120 is not limited to this and may be any insulating materials.

Figure 11:
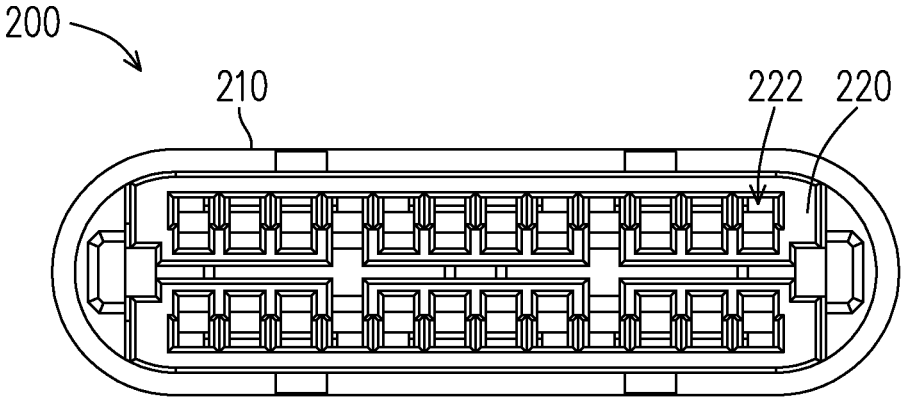
FIG. 11 is a schematic diagram illustrating the electrical connector shown in FIG. 9, in which a terminal is hidden.
Figure 12:
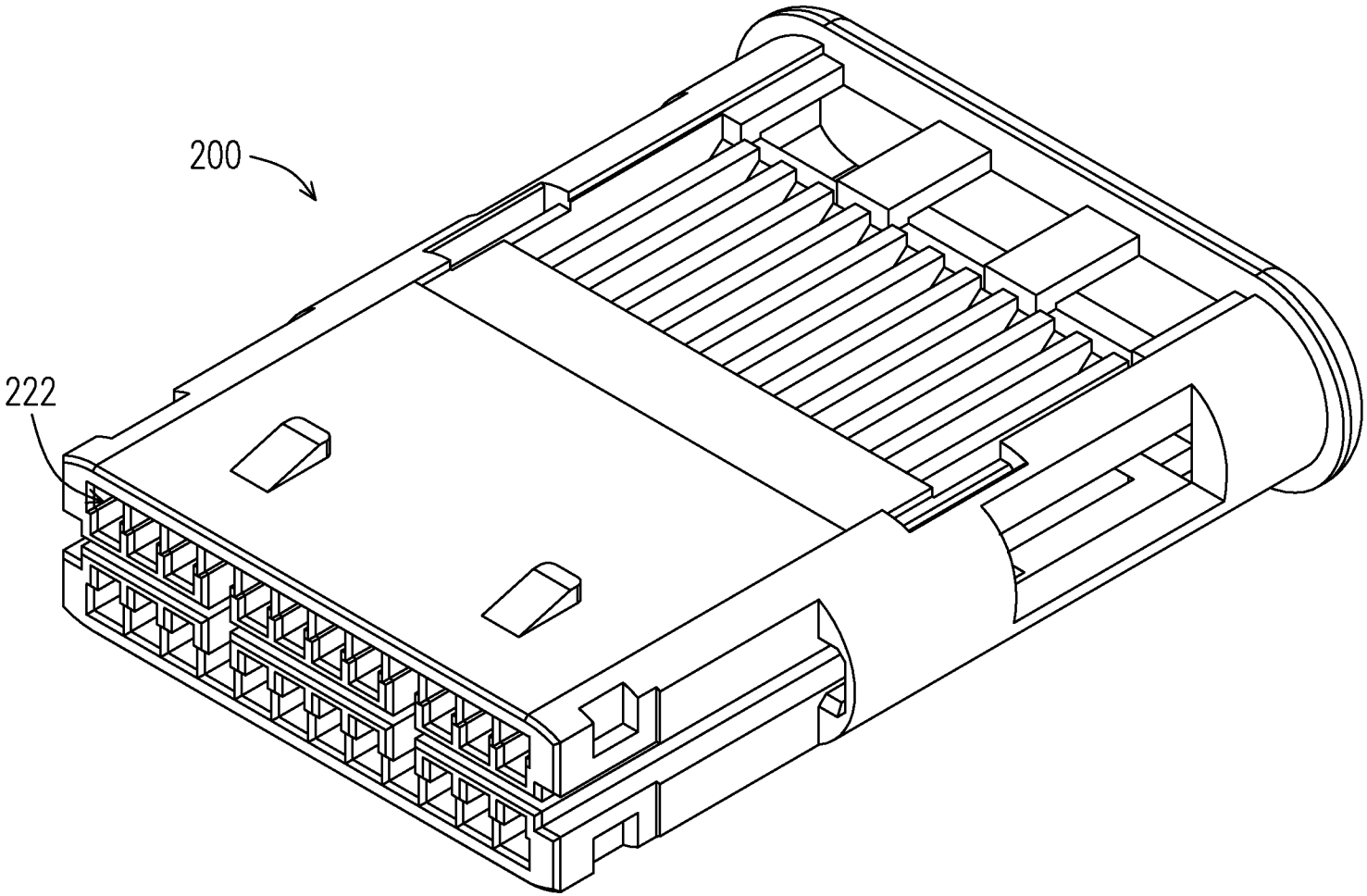
FIGS. 12 to 14 are other perspective views of an insulative base the electrical connector shown in FIG. 9.
Figure 13:
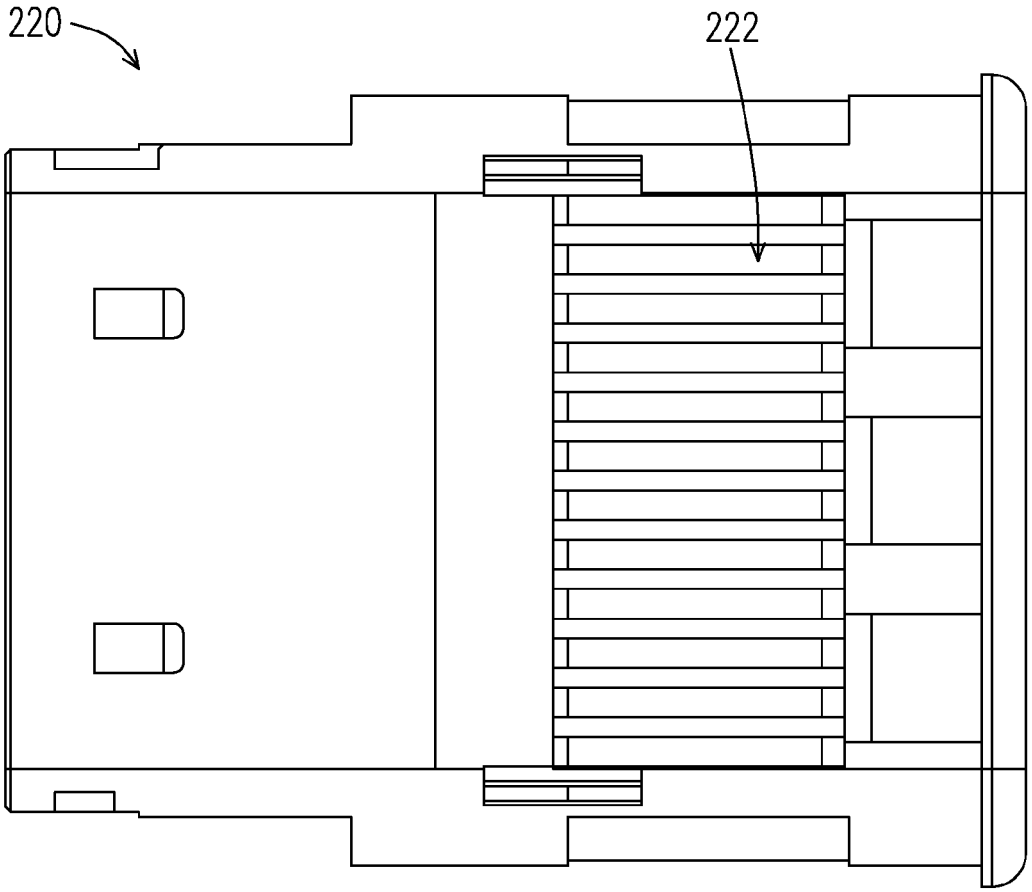
Figure 14:
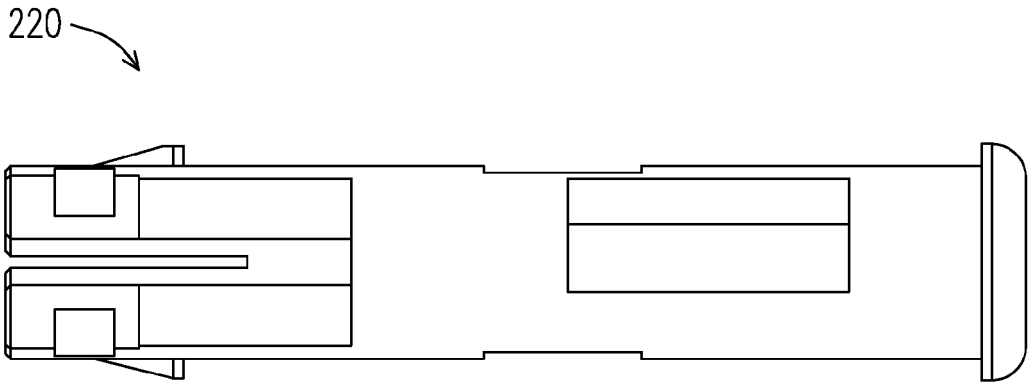
Figure 15:
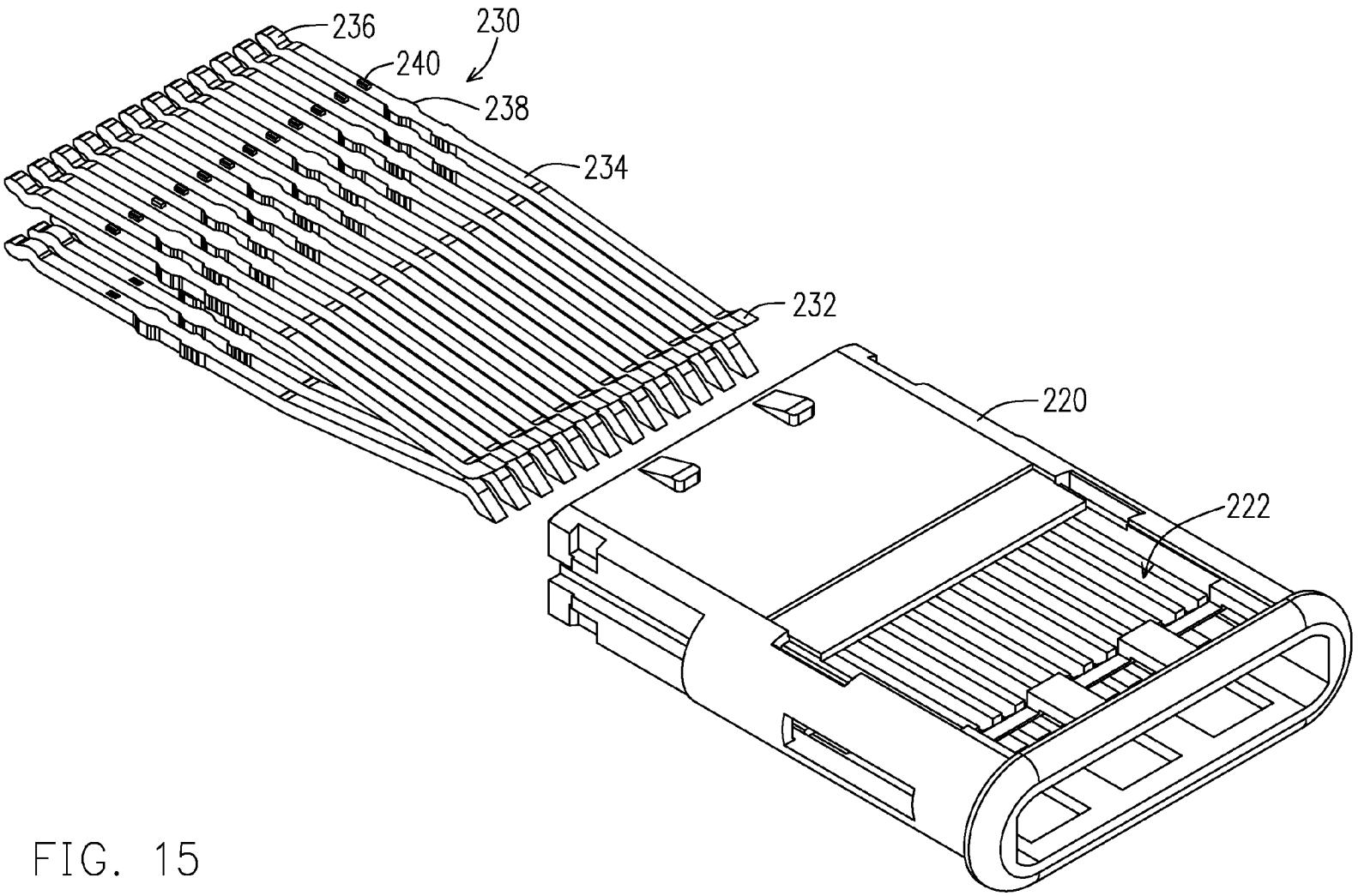
FIG. 15 is an exploded view illustrating the insulative base and the terminal of the electrical connector shown in FIG. 9.

FIG. 11 is a schematic diagram illustrating the electrical connector shown in FIG. 9, in which a terminal is hidden. FIGS. 12 to 14 are other perspective views of an insulative base of the electrical connector shown in FIG. 9. FIG. 15 is an exploded view illustrating the insulative base and the terminal of the electrical connector shown in FIG. 9. As shown in FIGS. 11 to 14, in the embodiment, the insulative base 220 includes a plurality of receiving opening 222 arranged in two rows. As shown in FIG. 15, the terminals 230 are arranged in two rows corresponding to the receiving openings 222. The number of each row of the receiving openings 222 and the number of each row of the terminals 230 are both 12, and the terminals 230 are disposed in the receiving openings 222. Each terminal 230 includes a contact portion 232, a center portion 234 and a connecting portion 236. The contact portion 232 is used for contacting a docking terminal (not shown). The connecting portion 236 is used for connecting a printed circuit board (not shown). Each terminal 230 further includes an actuator 240, and the actuator 240 is protruded from the center portion 234 along a normal line N, which is the thickness direction of the center portion 234, of a contact area of the contact portion 232. In the embodiment, the actuator 240 is rectangular. However, the shape of the actuator 240 is not limited to this.

Figure 16:
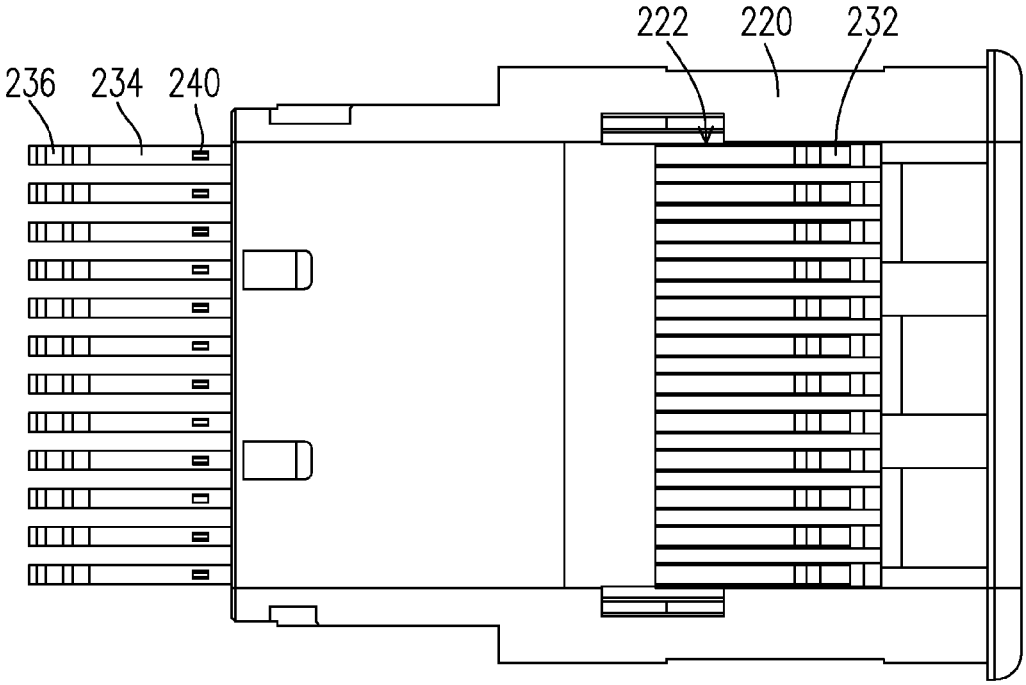
FIGS. 16 and 17 are schematic diagrams illustrating the electrical connector shown in FIG. 15, in which the terminal is penetrated in advance into the insulative base.
Figure 17:
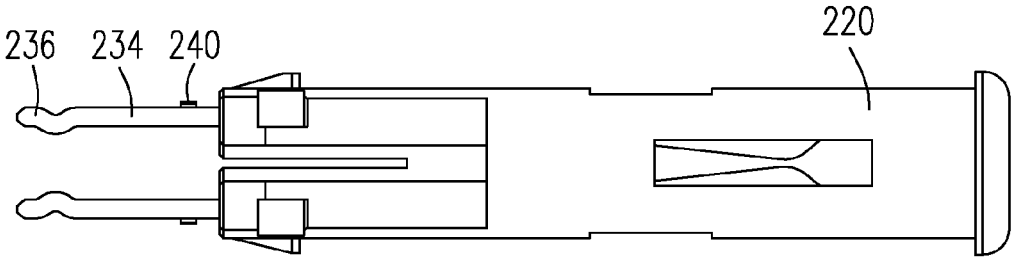
Figure 18:
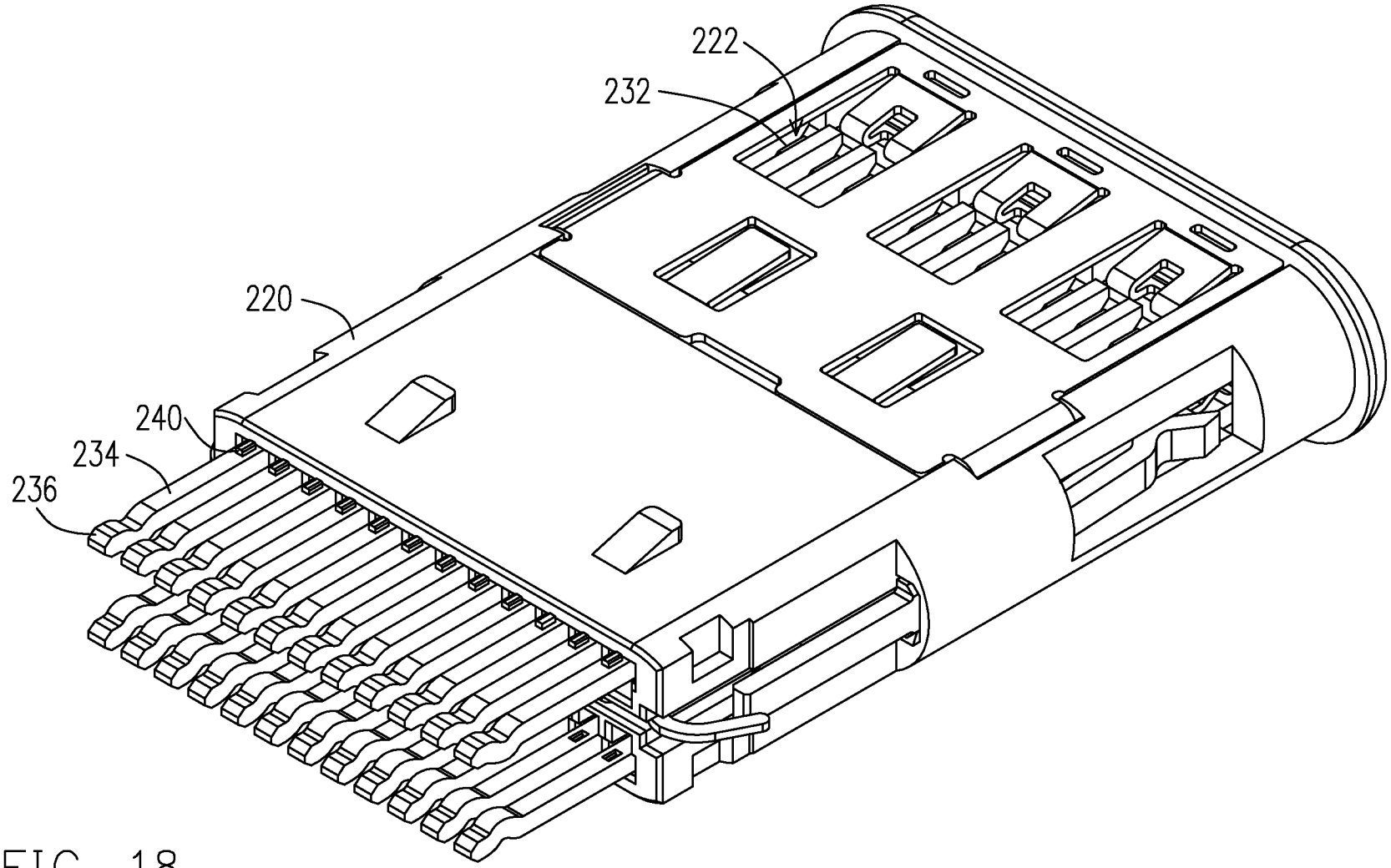
FIGS. 18 to 20 are schematic diagrams illustrating the electrical connector shown in FIG. 15, in which the terminal is installed into the insulative base.
Figure 19:
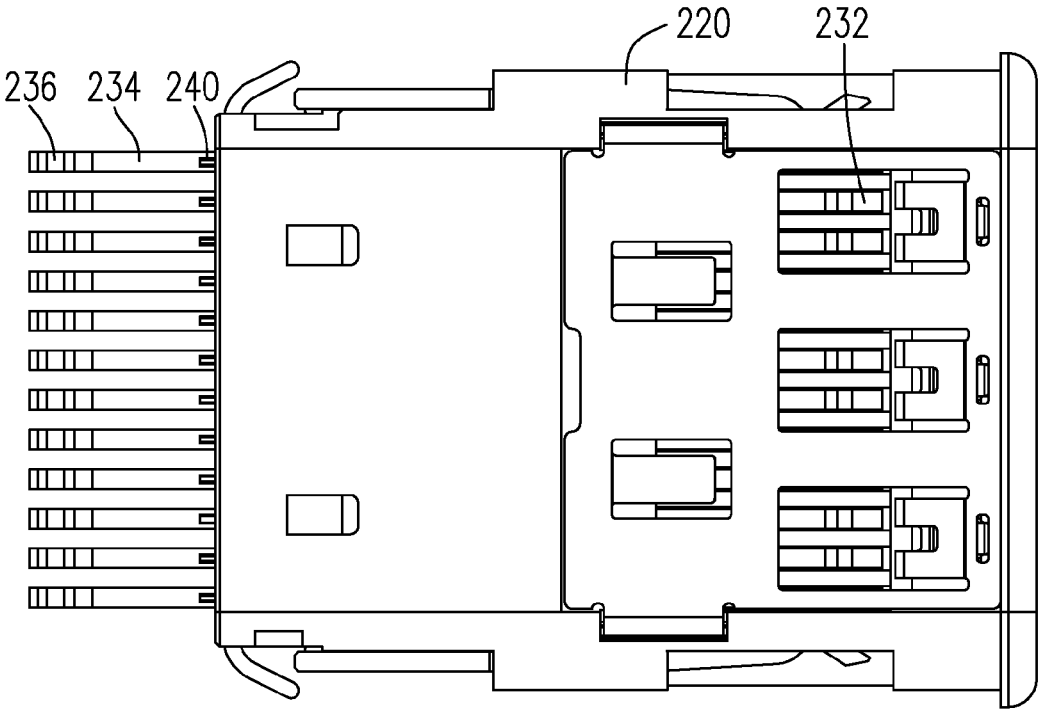
Figure 20:
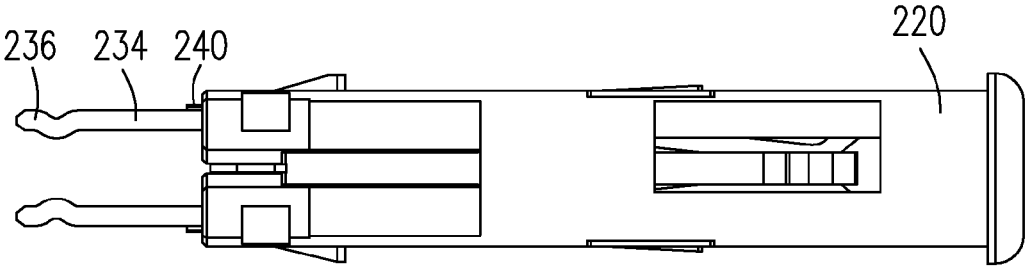

FIGS. 16 and 17 are schematic diagrams illustrating the electrical connector shown in FIG. 15, in which the terminal is penetrated in advance into the insulative base. FIGS. 18 to 20 are schematic diagrams illustrating the electrical connector shown in FIG. 15, in which the terminal is installed into the insulative base. In the embodiment, the terminal 230 is fixed on the insulative base 220 by installation. Please refer to FIGS. 16 and 17, in which when the terminal 230 is fixed on the insulative base 220, it only requires disposing the contact portions 232 of the terminals 230 into the receiving openings 222 in advance as shown in FIGS. 16 and 17 (in this status, the actuator 240 disposed on the center portion 234 is not contacted with the insulative base 220) in such a manner that the actuator 240 then can be pushed by an operator by using jigs or by hand so as to push the contact portion 232 into the receiving openings 222. When the contact portion 232 is pushed into the receiving openings 222, the actuator 240 is contacted with the principle base 121 of the insulative base 220 as shown in FIGS. 18 to 20, and the installation is completed.

In the embodiment, through the disposition of the actuator 240, the pushing force, which is applied by using jigs and is used for pushing the actuator 240 of the terminals 230, is constant, so the terminals 230 are not easily skewed when being installed into the insulative base 220. Even when the actuator 240 is pushed by hand, the existing of the actuator 240 increases the contacting area between the fingers of operator and the terminals 230, thereby increasing the probability of correctly installing the terminals 230 into the insulative base 220.

Moreover, please refer back to FIG. 15. In order to securely fix the terminals 230 on the insulative base 220, in the embodiment, the center portion 234 is provided with a retainer 238 which is located on a section between the actuator 240 and the contact portion 232 in a way of being extended in the width direction of the center portion 234. When the installation of the terminals 230 and the insulative base 220 is completed, the retainer 238 is engaged with the insulative base 220 to achieve a retaining function.

Figure 21:
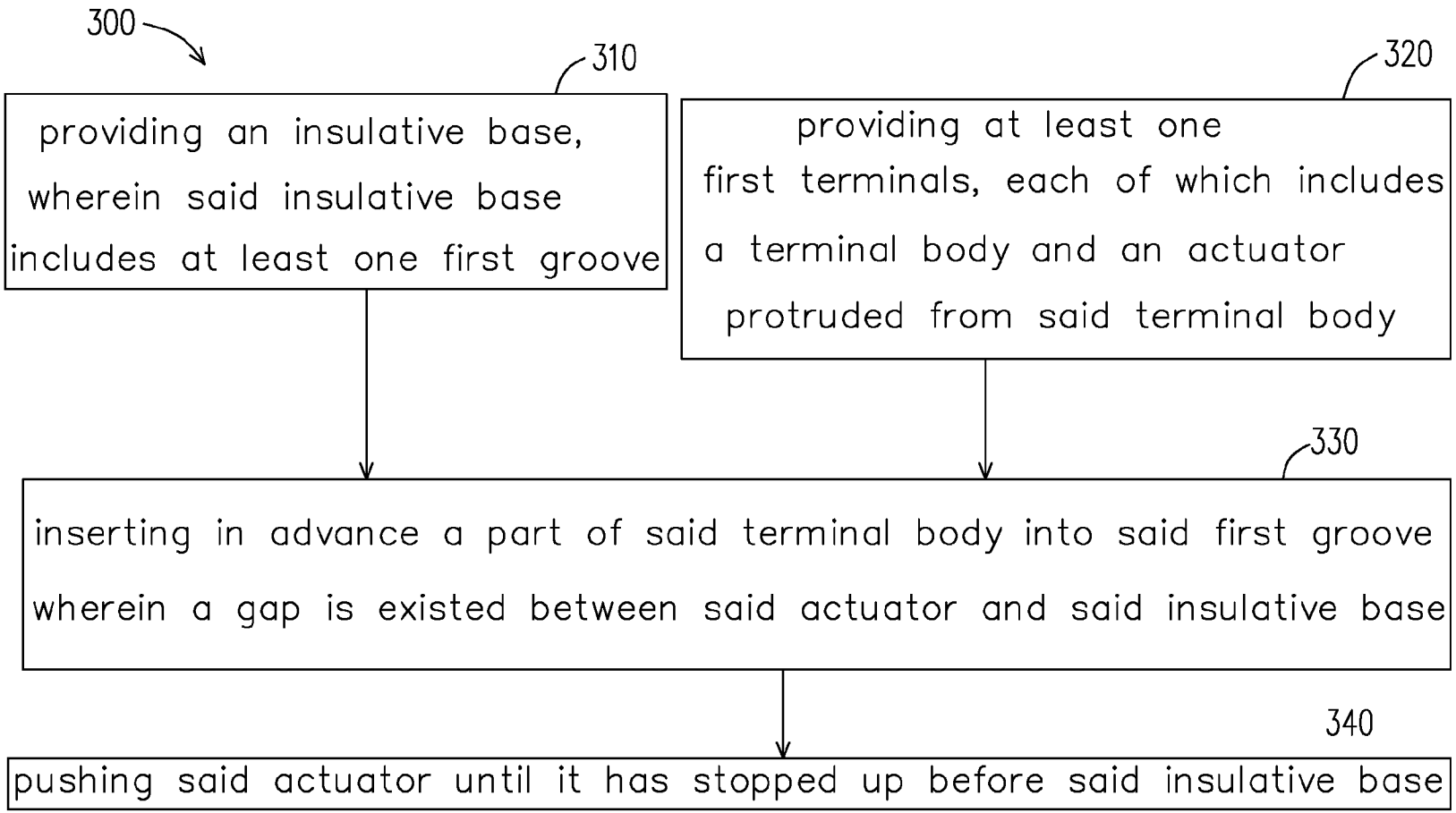
FIG. 21 is a flow diagram illustrating a manufacturing method of the electrical connector according to an embodiment of the present invention.

FIG. 21 is a flow diagram illustrating a manufacturing method of the electrical connector according to an embodiment of the present invention. Please refer to FIG. 21, in which a manufacturing method of the electrical connector 300 according to the embodiment includes the steps of: providing an insulative base, wherein the insulative base includes at least one first groove (Step 310); and providing at least one first terminals, each of which includes a terminal body and an actuator protruding from the terminal body (Step 320).

In the next steps a part of the terminal body is penetrated in advance into the at least one first groove, wherein a gap is existed between the actuator and the insulative base (Step 330); and pushing the actuator until it contacts the insulative base (Step 340) to complete the assembling of the first electrical connector.

In summary, by providing and actuator protruding from the first center portion, the present invention possesses merit that, when the terminal is installed into the insulative base, it only requires the first contact portion of the terminal to be disposed in the first groove in advance such that the actuator may be pushed by an operator by using jigs or by hand to push the first contact portion into the top cavity to complete the assembling thereof. While the actuator is pushed by using jigs, the pushing force is constant, so the terminal is not easily skewed when being installed into the insulative base. Even when the actuator is pushed by hand, the existing of the actuator increases the contacting area between the fingers of operator and the terminal, thereby, increasing the probability of correctly installing the terminal into the insulative base.

While the invention has been described in terms of various specific embodiments, those skilled in the art will recognize that the invention can be practiced with modification within the spirit and scope of the claims.

What is claimed is:

1. An electrical connector, comprising:

a casing having an inner space and an opening communicated with said inner space;

an insulative base disposed in said inner space;

at least one first terminal disposed within said insulative base, including: a terminal body which have a first contact portion, a first center portion and a first connecting portion which are sequentially connected, wherein said first contact portion is adjacent to said opening for contacting a docking terminal, and said first connecting portion is predetermined to connect with a printed circuit board; and an actuator protruding from said first center portion along a normal line of a contact area of said first contact portion, and has a stopper which is engaged with and stopped by said casing;

a plurality of second terminals and a plurality of third terminals, wherein said principle base further includes a plurality of second grooves extending along a longitudinal direction, and said tongue includes a plurality of bottom cavities extending along a longitudinal direction and communicating with these second grooves, as these bottom cavities are exposed on the bottom surface of said tongue, wherein said plurality of second terminals and said plurality of third terminals penetrate these second grooves and are located within said bottom cavities; wherein the actuator includes an actuator face adjacent to said first connecting portion and a ramped portion adjacent to said first contact portion; said actuator face is perpendicular to a perimeter of said first center portion in contact with said actuator, wherein the angle between said ramped portion and said perimeter is not a right angle, and said ramped portion faces toward said first contact portion and is engaged with and stopped by said principle base; wherein said first center portion is provided with a retainer which is located on a section between said actuator and said first contact portion and extends in a direction perpendicular to said normal line, as said retainer is engaged with said principle base.

2. The electrical connector of claim 1, wherein said the insulative base includes a principle base and a tongue which protrudes from said principle base and extending along a longitudinal direction, wherein the position of the tongue is more adjacent to said opening as compared with that of said principle base; and said principle base includes at least one first groove extending along the longitudinal direction, said tongue includes at least one top cavity extending along the longitudinal direction and communicating with the at least one first groove, and said at least one top cavity is exposed on the top surface of said tongue, wherein said first contact portion is located within said top cavity of said tongue, and said first center portion penetrates through said first groove.

3. The electrical connector of claim 1, wherein each of said second terminals includes a second connecting portion, and each of said third terminals includes a third connecting portion, and these second connecting portions and these third connecting portions are located in different planes.

4. The electrical connector of claim 1, wherein the at least first terminal has a substantially 90 degree elbow between the actuator and the first connecting portion.

5. The electrical connector of claim 4, where the at least first terminal further has a second substantially 90 degree elbow at the first connecting portion.

6. A manufacturing method for an electrical connector, comprising steps as follows:

a) providing an insulative base, wherein said insulative base includes at least one first groove;

b) providing at least one first terminals, each of which includes a terminal body and an actuator protruded from said terminal body;

c) inserting in advance a part of said terminal body into said first groove, wherein a gap is existed between said actuator and said insulative base; and d) pushing said actuator until the actuator has engaged with and stopped by said casing; wherein said terminal body includes a first contact portion, a first center portion and a first connecting portion which are sequentially connected, wherein said actuator protrudes from said first center portion in a direction along said normal line of a contact area of said first contact portion; wherein step c) inserting in advance the part of said terminal body into said first groove, said first contact portion is disposed in said first groove; wherein said actuator includes an actuator face adjacent to said first connecting portion and a ramped portion adjacent to said first contact portion, wherein said actuator face is perpendicular to a perimeter of said first center portion in contact with said actuator, wherein the angle between said ramped portion and said perimeter is not a right angle, and said ramped portion faces toward said first contact portion; wherein said first center portion is provided with a retainer which is located on a section between said actuator and said first contact portion and extends in a direction perpendicular to said normal line, wherein said retainer is engaged with said principle base as said actuator has stopped by said casing.

7. The manufacturing method of electrical connector of claim 6, wherein said insulative base includes a principle base and a tongue protruded from the principle base and extending along a longitudinal direction, said principle base includes at least one first groove extending along the longitudinal direction, said tongue includes at least one top cavity extending along the longitudinal direction and communicating with said at least one first groove, and said top cavity is exposed on the top surface of said tongue.

8. The manufacturing method of electrical connector of claim 6, wherein said actuator has stopped by said casing, said first contact portion is inserted into said top cavity, said first center portion penetrates through said first groove, and said actuator has a stopper which is applied against on stopped by casing.

* * * * *